United States Patent [19]

Weber et al.

[11] Patent Number: 4,508,224

[45] Date of Patent: Apr. 2, 1985

[54] CONTAINER FOR PHOTOGRAPHIC FILMS AND PRINTS

[75] Inventors: Klaus Weber, Leverkusen; Friedrich Hujer, Grünwald; Ferdinand Schaner, Munich, all of Fed. Rep. of Germany

[73] Assignee: Agfa-Gevaret Aktiengesellschaft, Leverkusen, Fed. Rep. of Germany

[21] Appl. No.: 306,391

[22] Filed: Sep. 28, 1981

Related U.S. Application Data

[63] Continuation-in-part of Ser. No. 885,115, Mar. 10, 1978, abandoned.

[30] Foreign Application Priority Data

Apr. 9, 1977 [DE] Fed. Rep. of Germany ..... 2716011
Jul. 31, 1981 [DE] Fed. Rep. of Germany ..... 3130375

[51] Int. Cl.[3] ..... B65D 27/08; B65D 27/10

[52] U.S. Cl. ..... 206/455; 229/69; 229/72

[58] Field of Search ..... 229/56, 69, 72, 53; 206/455, 390, 820; 150/39; 402/79; 40/404, 405, 159; 383/37, 38

[56] References Cited

U.S. PATENT DOCUMENTS

| | | | |
|---|---|---|---|
| 2,568,941 | 9/1951 | Benson | 229/72 |
| 3,142,437 | 7/1964 | Grant et al. | 229/53 |
| 3,348,762 | 10/1967 | Kasinkas | 206/390 |
| 3,391,855 | 7/1968 | Ansell | 229/72 |
| 3,548,526 | 12/1970 | Oakley | 229/69 |
| 3,620,440 | 11/1971 | Humphrey | 229/72 |
| 3,817,445 | 6/1974 | Greason | 229/69 |
| 3,900,160 | 8/1975 | Goto et al. | 206/820 |
| 3,990,625 | 11/1976 | Jelling et al. | 206/390 |
| 4,065,864 | 1/1978 | Stanley et al. | 40/405 |
| 4,317,538 | 3/1982 | Alter et al. | 229/72 |

FOREIGN PATENT DOCUMENTS

| | | | |
|---|---|---|---|
| 1536635 | 3/1970 | Fed. Rep. of Germany | 40/404 |
| 1078540 | 11/1954 | France | 40/405 |
| 52-21923 | 2/1977 | Japan | 40/405 |
| 1038621 | 8/1966 | United Kingdom | 40/405 |
| 1054210 | 1/1967 | United Kingdom | 40/405 |
| 1,421,906 | 1/1976 | United Kingdom | 229/69 |

*Primary Examiner*—Stephen P. Garbe
*Attorney, Agent, or Firm*—Peter K. Kontler

[57] ABSTRACT

A deformable container for sections of developed photographic roll films and for prints of images on such film sections has a square or rectangular base sheet of paper, cardboard or the like and a cover sheet of paper or synthetic plastic material. The sheets overlie each other and are bonded to one another along three marginal sections and a median section to define a narrower film compartment and a wider print compartment. Both compartments are open at those ends which face the fourth marginal sections of the sheets. One or more fold lines are provided between the two compartments to allow for folding of one compartment over the other compartment. Several containers form a strip of coherent containers, and the containers of the strip can be formed with one or more rows of perforations to facilitate automatic transport in a photographic processing laboratory wherein the film sections and the prints are introduced into the respective compartments by automatic equipment. The open ends of compartments can face a marginal portion of the base sheet or the closed ends of compartments of the adjacent container. Slots or similar markers are provided adjacent to partitions between the compartments. Such markers serve to allow for stoppage of the strip when the compartments of a container are ready to receive film sections and prints, and/or to initiate separation of the foremost container from the next-following container of the strip.

17 Claims, 13 Drawing Figures

Fig. 1
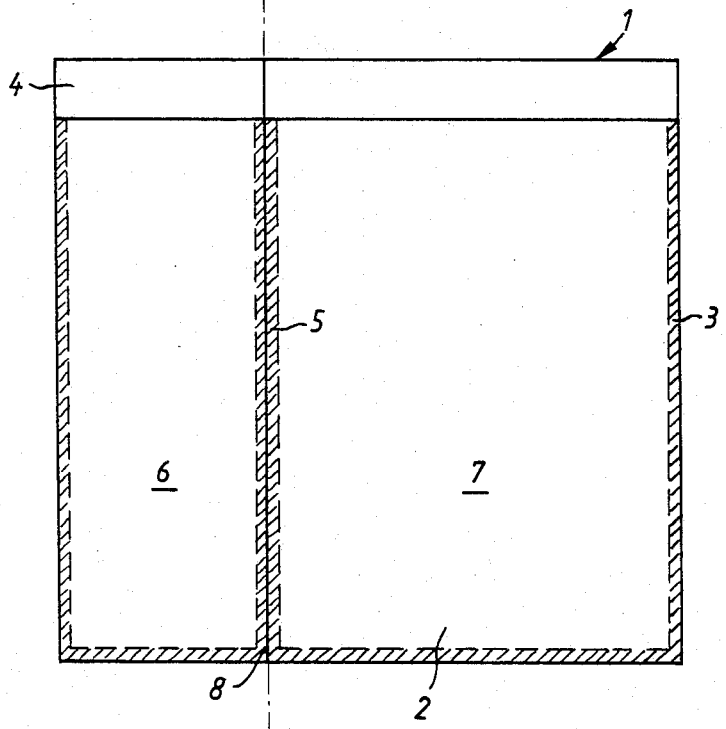
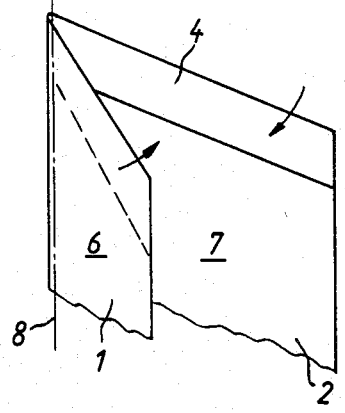
Fig. 2
Fig. 2a
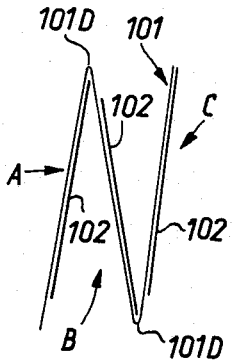

Fig. 3a
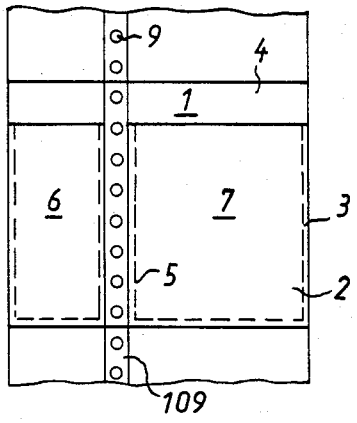
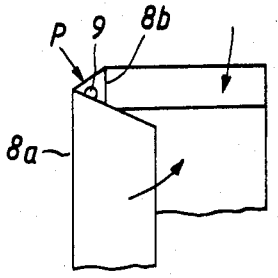
Fig. 3b
Fig. 4a
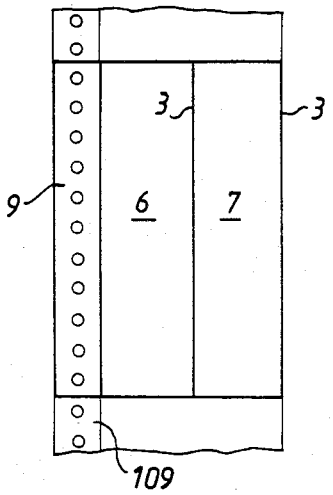
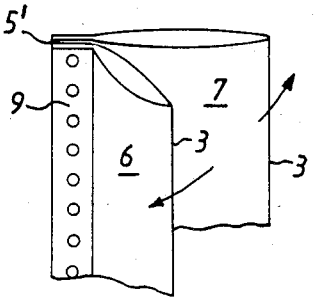
Fig. 4b
Fig. 5a
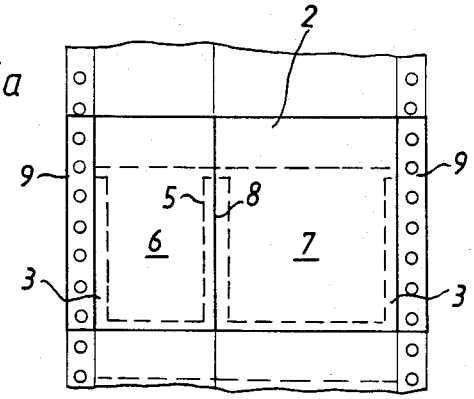
Fig. 5b
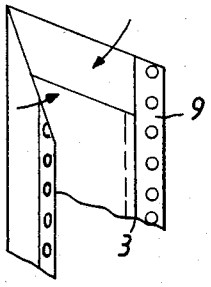

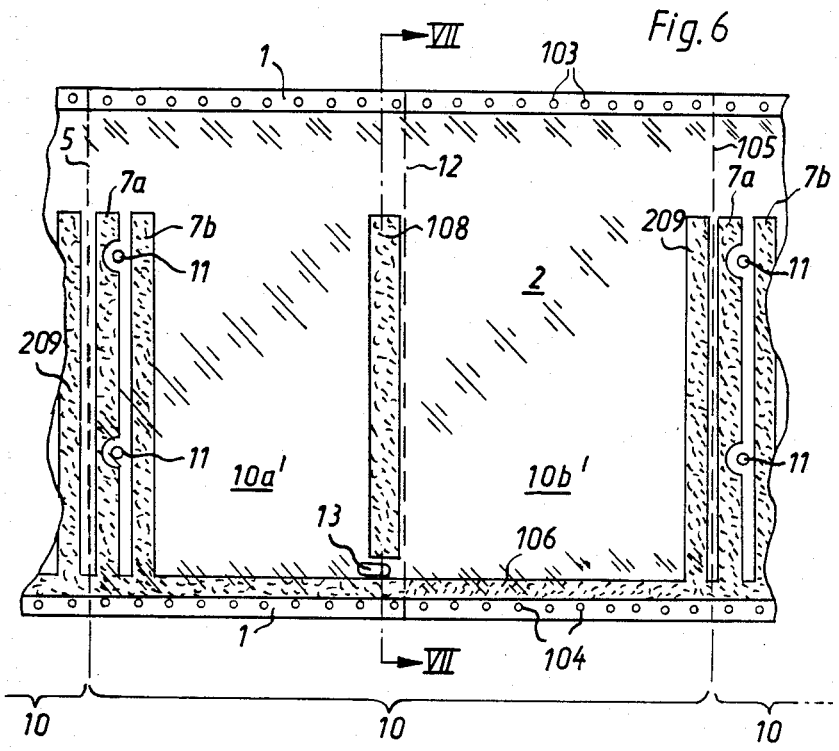
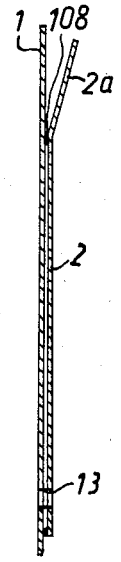
Fig. 7
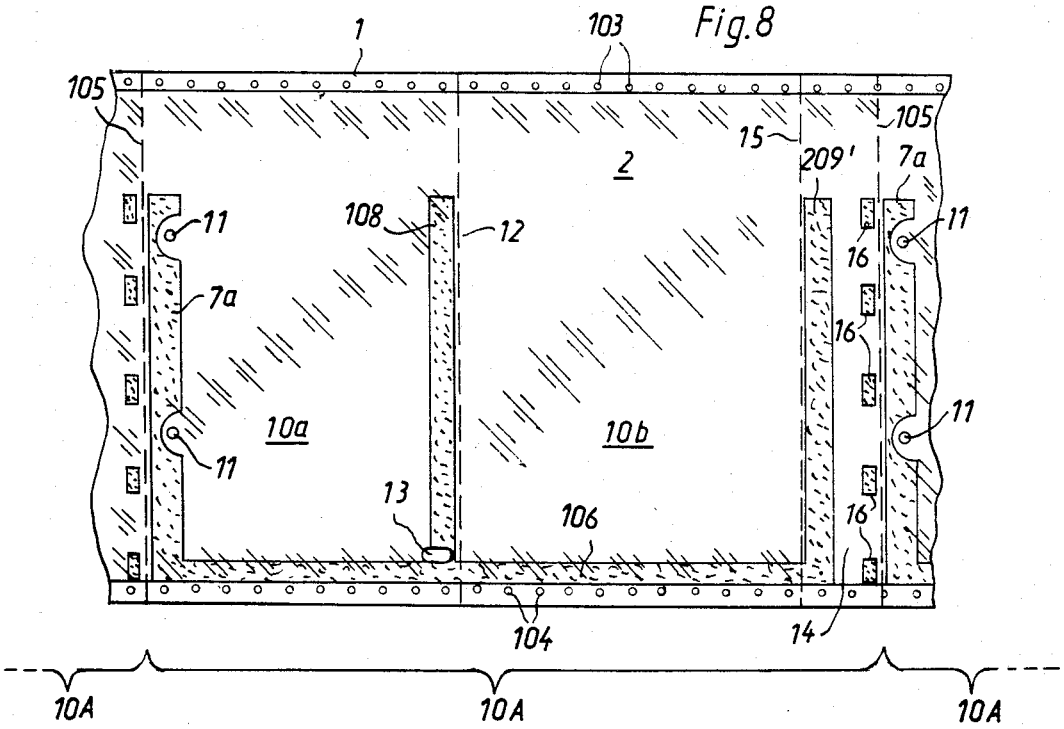

CONTAINER FOR PHOTOGRAPHIC FILMS AND PRINTS

CROSS-REFERENCE TO RELATED APPLICATION

This is a continuation-in-part of the copending application Ser. No. 885,115 filed Mar. 10, 1978, now abandoned, by Klaus Weber and Friedrich Hujer for "Container for Photographic Films and Prints", now abandoned.

BACKGROUND OF THE INVENTION

The present invention relates to containers for sheet-like commodities, especially to containers for reception of sections of developed films and of prints belonging to customer orders. Such containers are used for storage of sections of developed roll films which have been shipped or delivered by dealers or customers to a photographic processing laboratory as well as for storage of prints which are produced in the laboratory. The containers are picked up by customers or dealers, or mailed or shipped to the customers or dealers in boxes, envelopes or analogous receptacles.

Presently known containers for film sections normally consist of parchment paper or the like and are filled by hand. The containers are bonded to envelopes consisting of cardboard or the like. Each envelope has a prefabricated pocket or compartment for reception of prints which are inserted by hand. Such containers and envelopes are not suited for automatic introduction of film sections and/or prints.

German Offenlengungsschrift No. 2,445,829 discloses a container which serves for reception of film sections and is open at opposite sides. Such containers can be filled by resorting to automatic film introducing apparatus. A filled container is thereupon assembled, by hand, with a discrete container for prints. The manual work entails a highly undesirable reduction of the output of automatic film processing equipment in photographic laboratories wherein the means for subdividing customer film into sections (each of which contains a given number of film frames, e.g., four or six frames) and the means for subdividing a strip of exposed and developed photographic paper into prints operate at an extremely high speed. Furthermore, the just discussed discrete containers for film sections and prints are rather complex and expensive.

OBJECTS AND SUMMARY OF THE INVENTION

An object of the invention is to provide a novel and improved container for sections of developed films and for corresponding photographic prints which is simpler and less expensive than heretofore known containers, which can be mass-produced in available machines, and which can be automatically filled with prints and film sections.

Another object of the invention is to provide a container which can be collapsed into a small package prior to and also subsequent to filling.

A further object of the invention is to provide a container which can be filled as well as transported in a processing laboratory by automatic machinery and which affords convenient access to its contents.

An additional object of the invention is to provide a container which is constructed and assembled in such a way that it can receive film sections simultaneously with corresponding prints.

Another object of the invention is to provide a container which can constitute one of a long series of coherent but readily separable containers which can be readily manipulated by automatic transporting equipment in a film processing laboratory.

An ancillary object of the invention is to provide a container which can be produced with substantial savings in material and whose dimensions are just sufficient to adequately confine a requisite number of film sections and the corresponding prints.

The invention is embodied in a container for film sections and photographic prints belonging to a customer order. The container resembles a flat folding pocketbook or wallet and comprises two overlapping sheets each having four marginal sections, and a suitable adhesive or other securing means for bonding or otherwise fastening three marginal sections of one sheet to the corresponding marginal sections of the other sheet. The sheets have coherent strip-shaped portions extending substantially transversely of their fourth marginal sections so that the sheets define two compartments or pockets one of which can receive film sections and the other of which can receive prints. The compartments are open at those ends which are adjacent to the fourth marginal sections of the sheets. The fourth marginal section of one sheet may but need not extend beyond the corresponding marginal section of the other sheet, and the other sheet is preferably transparent or translucent to allow for inspection of its contents.

The strip-shaped portions of the sheets are preferably provided with or flanked by elongated weakened portions or fold lines which allow for folding of the container so that one of the compartments overlies the other compartment.

Several containers can form an elongated series or strip of coherent containers which are disposed end-to-end, and such strip is preferably provided with one or more longitudinally extending rows of perforations to facilitate automatic transport in a processing laboratory.

The open ends of compartments forming part of one container of a series or strip of two or more coherent containers can face the closed ends of compartments in the neighboring container. However, it is often preferred to orient the compartments in such a way that their open ends face one marginal portion and their closed ends are adjacent to the other marginal portion of the strip. Furthermore, each container is preferably provided with one or more notches, slots, holes or other markers or indicia which can be detected by suitable monitoring means. For example, such monitoring means can arrest the strip in an apparatus which admits film sections and prints so that the compartments of consecutive containers are held in exact alignment with the corresponding components of the apparatus preparatory to and during introduction of film sections and prints. Also, the monitoring means can initiate separation of successive containers from the next-following container prior to, during or subsequent to introduction of prints and film sections into the corresponding compartments. The positions of the markers are selected in such a way that an arrested container maintains its compartments in accurate register with the film and print admitting means irrespective of the dimensions of the containers and/or their compartments.

The novel features which are considered as characteristic of the invention are set forth in particular in the appended claims. The improved container itself, however, both as to its construction and the mode of producing and utilizing the same, together with additional features and advantages thereof, will be best understood upon perusal of the following detailed description of certain specific embodiments with reference to the accompanying drawing.

BRIEF DESCRIPTION OF THE DRAWING

FIG. 1 is a plan view of a container which embodies one form of the invention;

FIG. 2 is a fragmentary perspective view of the container of FIG. 1 in partly folded condition;

FIG. 2*a* is a schematic end elevational view of a series or strip of coherent containers of the type shown in FIGS. 1 and 2;

FIG. 3*a* is a plan view of a modified container which forms part of a series or strip of coherent containers;

FIG. 3*b* is a fragmentary perspective view of the container of FIG. 3*a* in partly folded condition;

FIG. 4*a* is a plan view of a third container in folded condition;

FIG. 4*b* is a fragmentary perspective view of the container of FIG. 4*a* in partly folded condition;

FIG. 5*a* is a plan view of a fourth container;

FIG. 5*b* is a fragmentary perspective view of the fourth container in partly folded condition;

FIG. 6 is a fragmentary plan view of a series or strip of several coherent containers which are constructed and assembled in accordance with a further embodiment of the invention;

FIG. 7 is a sectional view as seen in the direction of arrows from the line VII—VII of FIG. 6;

FIG. 8 is a fragmentary plan view of a modified strip; and

DESCRIPTION OF THE PREFERRED EMBODIMENTS

Figure 9:
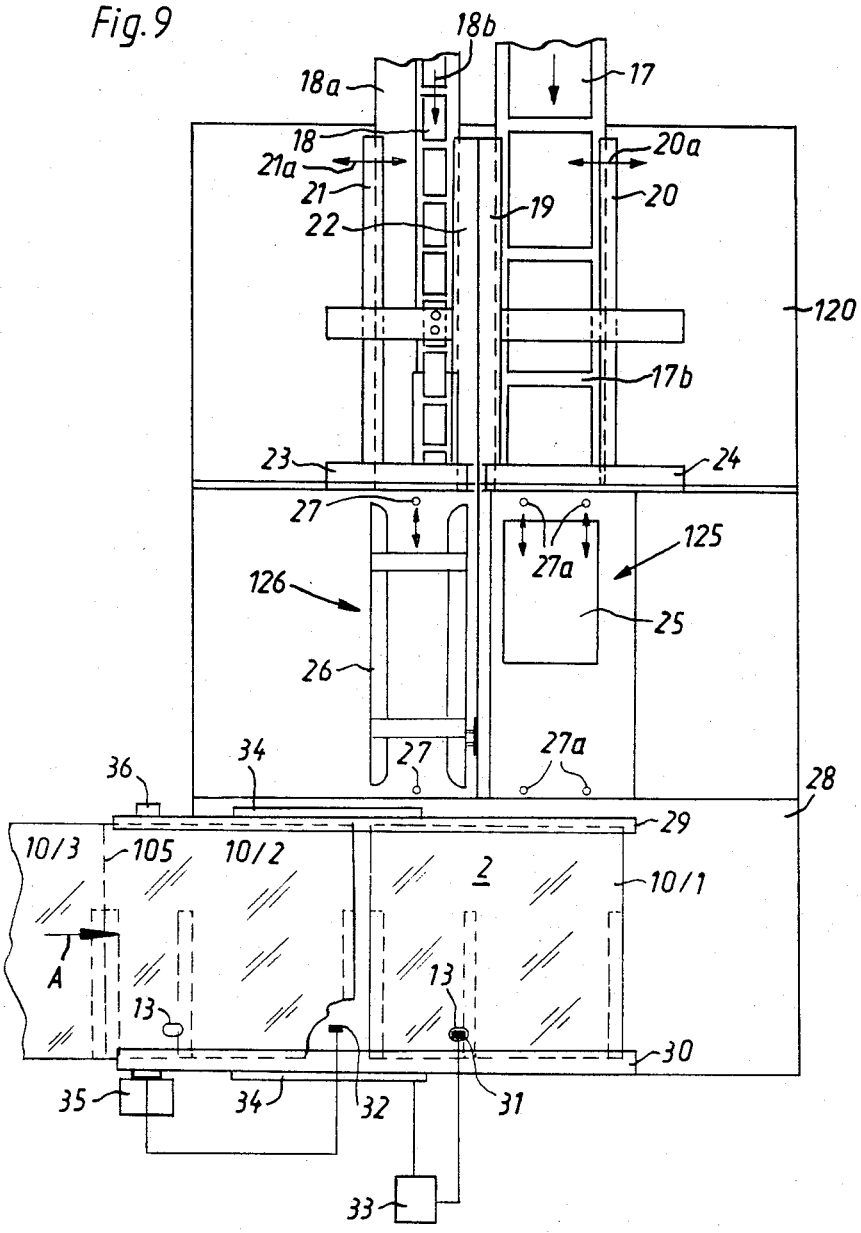
FIG. 9 is a schematic plan view of an apparatus which can process strips of the type shown in FIGS. 6 and 8.

FIG. 1 is a plan view of a container which comprises a square or rectangular base sheet or web 1 and a second sheet or cover 2 which overlies the base sheet so that three marginal portions or sections of the two sheets are juxtaposed upon each other. Such three marginal sections are secured to each other by layers 3 of adhesive. Thus, the sheets 1 and 2 form an envelope which is open at one side, namely, along the upper (fourth) marginal sections of the two sheets, as viewed in FIG. 1. Two elongated strip-shaped portions of the sheets 1 and 2 are bonded to each other by a layer of adhesive so that they form a straight partition 5 extending substantially at right angles to the upper marginal sections and dividing the aforementioned envelope into a narrower film pocket or compartment 6 at one side and a wider print compartment or pocket 7 at the other side of the partition. The open ends of the compartments 6 and 7 are adjacent to the upper marginal section 4 of the base sheet or web 1. This marginal section extends beyond the corresponding (fourth) marginal section of the cover 2.

The web 1 may be made of paper, lightweight cardboard or synthetic plastic material. The cover 2 may be made of paper or a synthetic plastic material, preferably of parchment, acetate, polyethylene, polyester foil or any other sheet material which transmits light so as to enable a person to observe the uppermost film section in the compartment 6 and the uppermost print in the compartment 7.

The projecting marginal section 4 of the base sheet 1 can be grasped by one or more hooks, pawls, teeth, jaws or analogous clamping or gripping means preparatory to introduction of film sections and prints into the respective compartments, and the outer sides of the cover sheet 2 are thereupon attracted by suction cups at both sides of the partition 5 to thus expand the open ends of the compartments 6 and 7 in order to facilitate (preferably simultaneous) automatic introduction of film sections and prints belonging to a customer order.

The dimensions of the compartment 6 preferably only slightly exceed the dimensions of a film section (e.g., a section including a row of four or six coherent film frames). The same preferably applies for the compartment 7, i.e., the dimensions of this compartment will normally slightly exceed the dimensions of a print so as to ensure that an entire stack of prints with images corresponding to those of film frames in the compartment 6 can be readily introduced into the compartment 7 by automatic means.

FIG. 1 further shows that the sheets 1 and 2 are formed with straight elongated registering auxiliary or additional weakened portions 8 (which can be obtained by creasing the sheets along a line which is substantially normal to the upper marginal sections of the sheets, as viewed in FIG. 1, or which is obtained by providing the sheets with a line of small perforations). The auxiliary weakened portions or fold lines 8 enable a machine or a person to fold the compartment 6 over the compartment 7 or vice versa in a manner as shown in FIG. 2 so as to reduce the space requirements of the container during shipment to a dealer or directly to the customer, as well as when the container is carried along in a pocket or purse.

The container of FIG. 1 is a discrete commodity. A large number of such containers can be stacked at an appropriate location in a photographic processing laboratory so that they may be removed, one-by-one, and transferred to a position for reception of film sections and prints, preferably from automatic inserting means adapted to fill the containers at the rate at which successive customer films are subdivided into sections and at which the corresponding prints are separated from a continuous strip of exposed and developed photographic paper. As mentioned above, the projecting marginal section 4 of the base sheet 1 can be grasped by mechanical or other means while the open ends of the compartments are expanded by suction cups or the like prior to automatic introduction of film sections and prints into the respective compartments 6 and 7.

It is also possible and preferable to manufacture the container 1 of FIG. 1 as one component of a continuous strip or series of coherent containers which are folded over each other in zig-zag fashion for convenient storage and transport to a desired location in a processing laboratory. This is shown schematically in FIG. 2*a* which illustrates three coherent containers A, B, C having a common base sheet or web 101 which has weakened portions at 101D so that the containers A, B and C can be readily separated from each other by exerting a slight pull in a direction to destroy the bond along the respective weakened portion or line 101D. The second sheets or covers 102 of alternate containers can be bonded to opposite sides of the sheet 101 so that each second container need not be turned upside down upon detachment from the remaining containers of the zig-zag shaped strip of FIG. 2*a*.

FIGS. 3*a* and 3*b* show a portion of a modified continuous strip or series of coherent containers. In order to facilitate transport of such containers in a processing laboratory, the partitions 5 are formed with a row of circular or otherwise configurated perforations 9 which permit entry of the teeth of pulleys, sprocket wheels or analogous transporting elements. The perforations 9 can be provided directly in the sheets of the containers or in a tape 109 which is secured to the strip of containers by a suitable adhesive.

The container of FIGS. 3*a* and 3*b* is formed with two elongated auxiliary or additional weakened portions 8*a* and 8*b* which flank the row of perforations 9 and allow for conversion of the container into a substantially U-shaped body with a narrow intermediate panel P which resembles the back of a book. An advantage of such containers is that they do not exhibit pronounced bulges when their compartments 6 and 7 are filled with film sections and prints. The width of the panel P approximates the anticipated combined maximum thickness of stacked film sections and prints which are to be inserted into a container.

FIGS. 4*a* and 4*b* show a modified container which forms part of a continuous series or strip of containers and is manufactured in folded condition as illustrated in FIG. 4*a*. The row of perforations 9 is provided in the doubled-over partition 5', i.e., each perforation may consist of four registering holes, two in the material of the base sheet or web and two in the material of the second sheet or cover. The perforations 9 may be provided in two tapes 109 which are bonded to the opposite outer sides of the folded-over partition 5'. When the container of FIGS. 4*a* and 4*b* is opened in a manner as shown in FIG. 4*b*, the partition 5' remains in the plane of one of the compartments 6 and 7. Alternatively, and when the container is fully open so that the compartments 6 and 7 are located side-by-side in a common plane, the partition 5' may extend at right angles to the common plane. Such construction may be desirable in certain processing laboratories employing transporting equipment which is designed to properly engage the partition 5' in a vertical plane while the compartments 6 and 7 are held in a horizontal plane.

FIGS. 5*a* and 5*b* show a further container which forms part of a continuous series or strip and wherein two parallel marginal sections are formed with rows of perforations 9. Alternatively, the perforations 9 may be outwardly adjacent to the respective marginal sections. The container of FIGS. 5*a* and 5*b* can be transported with a high degree of accuracy because it can be engaged by two discrete sprocket wheels or by two discrete toothed portions of an elongated sprocket wheel. The manner in which the adhesive 3 bonds the juxtaposed marginal sections of the container of FIGS. 5*a* and 5*b* to each other and in which the partition 5 divides the envelope into two discrete compartments 6 and 7 is similar or identical to that described in connection with FIGS. 1 and 2. Containers with two spaced-apart rows of perforations 9 are preferred when the compartments 6 and 7 must be dimensioned to receive sections of relatively wide films and relatively large prints. The partition 5 includes an additional or auxiliary weakened portion 8 which allows for convenient and reproducible folding of the container.

It will be noted that the adhesive bonds 3 which are adjacent to the two rows of perforations 9 and the bond between the strip-shaped portions which form the partition 5 need not extend all the way to the upper marginal section of the cover 2. Such types of containers are preferred in certain processing laboratories which utilize semiautomatic equipment for introduction of film sections and/or prints.

The improved containers can be used with advantage in many modern photographic processing laboratories which utilize high-speed severing means for customer films and for webs of exposed and developed photographic paper. When a container is filled with film sections and/or prints, it is preferably folded not unlike a wallet to occupy a minimum of space during storage and/or shipment or delivery to dealers or customers. As a rule, the improved container will be inserted into a customary box or envelope which is used for shipment of exposed but undeveloped photographic films to a processing laboratory and which also serves as a receptacle for film sections and prints during shipment to dealers or directly to customers. As mentioned above, the dimensions of the compartments preferably equal or only slightly exceed the dimensions of the commodities to be stored therein so that the space requirements of containers are minimal, not only prior but also subsequent to filling. Moreover, such construction results in substantial savings in material of the sheets 1 and 2.

FIG. 6 shows a strip of coherent containers 10 each of which includes a first pocket 10*a'* for film sections and a second pocket 10*b'* for prints. The strip comprises a continuous or elongated first sheet or web 1 which may consist of cardboard, paper or synthetic plastic material and is slightly wider than a second sheet or cover 2 which preferably consists of a transparent or translucent material such as parchment, acetate, polyethylene, polyester foil or the like. However, it is clear that the second sheet or cover 2 can also be made of paper or any other material which is similar to or identical with the material of the web 1. If the web 1 consists of cardboard, such material is preferably thin so that it does not take up a substantial amount of space when the strip including the web 1 and cover 2 is broken up or subdivided into discrete containers 10 each of which has two pockets, namely the pockets 10*a'* and 10*b'*. The web 1 is permanently connected with selected portions of the cover 2 so that those portions of the two sheets which adhere to each other define the outlines of the respective pockets 10*a'* and 10*b'*.

Those marginal portions or sections of the web 1 which extend beyond the corresponding marginal portions or sections of the cover 2 are provided with rows of perforations 103 and 104 adapted to be engaged by the pins or teeth of suitable transporting elements (pulleys or sprocket wheels) serving to advance the strip past an apparatus (see FIG. 9) which introduces film sections and prints into the respective pockets 10*a'* and 10*b'*. The two rows of perforations 103 and 104 extend in the longitudinal direction of the strip and the perforations of each row are equidistant from each other.

The strip is further formed with equidistant weakened portions 105 which constitute straight lines extending transversely of the longitudinal direction of the strip and partially separate the neighboring containers 10 from each other. The weakening at 105 can be effected by providing the corresponding portions of the web 1 and strip 2 with narrow slits which are separated from each other by intact portions of the material of the web 1 and cover 2 so that the weakened portions can be readily destroyed or broken in order to separate the neighboring containers 10 from each other, preferably prior to introduction of film sections and prints into the respective pockets 10*a*' and 10*b*'. Prior to separation of neighboring containers 10 from each other, the strip including the web 1 and cover 2 is folded back and forth along successive weakened portions 105 so that the strip forms a zig-zag formation (see FIG. 2*a*) which can be readily stored in a small area in an apparatus serving for introduction of prints and film sections into the corresponding compartments.

The web 1 and the cover 2 can be bonded or otherwise secured to each other in a number of ways. FIGS. 6 and 7 illustrate an embodiment wherein selected portions of the web 1 and cover 2 are bonded to each other by elongated securing means constituting layers of adhesive. Such layers include a continuous layer 106 which bonds one marginal portion of the cover 2 to the adjacent portion of the web 1 along the row of perforations 104 in the lower marginal portion of the web, as viewed in FIG. 6. The adhesive layers of each container 10 further comprise four elongated layers which extend transversely of the strip, namely, at right angles to the longitudinal direction of the adhesive layer 106. The four elongated layers include a median layer 108 which is slightly spaced apart from the layer 106 and separates the pockets 10*a*' and 10*b*' of the respective container 10 from each other, a layer 209 which is adjacent to the right-hand side of the pocket 10*b*' of the fully illustrated container 10 of FIG. 6 and to the left of the adjacent weakened portion 105, and two slightly spaced-apart layers 7*a*, 7*b* which together constitute the left-hand boundary of the pocket 10*a*' for the film sections. The length of each of the transverse layers 7*a*, 7*b*, 108 and 209 approximates or equals 75% of the width of the web 1 or cover 2. Therefore, the uppermost portion of the cover 2 is not attached to the web 1 but forms a tongue 2*a* (see the upper portion of FIG. 7) which can be folded away from the adjacent portion of the web 1. The tongue 2*a* extends along the row of perforations 103 and forms with the adjacent portion of the web 1 a funnel-like structure for convenient introduction of film sections and prints when the corresponding container 10 is adjacent to the filling station of the apparatus shown in FIG. 9.

The provision of two spaced-apart layers 7*a*, 7*b* with an unbonded portion therebetween is advisable and advantageous if a discrete container 10 is to be filed away in a customary way, namely, in the same manner as letters and/or other documents. To this end, the unbonded portions of the web 1 and cover 2 between the respective layers 7*a* and 7*b* are formed with two or more holes 11 so that they can receive the prongs of customary fasteners of the type used in office filing systems or the like. The separated containers 10 can also be stored or filed away in a suitable album if such album is provided with means for accepting fasteners of the type normally used in office files.

The holes 11 are provided along the left-hand edge of each container 10 when the strip of such containers is oriented in a manner as shown in FIG. 6, namely, so that the cover 2 is superimposed upon the web 1, the open ends of the compartments 10*a*', 10*b*' face upwardly and the closed ends of the the compartments 10*a*', 10*b*' face downwardly, as viewed in FIG. 6. This ensures that each container 10 can be properly filed away in such a manner that its cover 2 faces the person opening the folder or album in which the container 10 is confined.

The layer 209 is preferably immediately or closely adjacent to the respective weakened portion 105 but is slightly spaced apart from the layer 7*a* between the web 1 and cover 2 of the adjacent container 10. This can be readily seen in the left-hand and right-hand portions of FIG. 6.

The dimensions (length) of the containers 10 can be varied by changing the distance between the neighboring weakened portions 105. If such distance is changed, it normally entails corresponding changes in the distance between the layer 108 and layer 209 on the one hand, and the layer 108 and layer 7*b* on the other hand. In other words, the container 10 can be furnished in a number of different sizes, one for each of various film section sizes and/or print sizes.

Each container 10 is further formed with an additional or auxiliary weakened portion 12 which is parallel to the weakened portions 105 and layers 108, 209, 7*a* and 7*b* and is closely adjacent to the median layer 108 at that side which forms part of the respective pocket 10*b*' for photographic prints. The portion 12 need not be weakened to the same extent as the portions 105 so that it remains intact when the strip including a series of coherent containers 10 is broken up into discrete containers by holding the trailing container while applying a tensional stress or pull to the preceding container in order to destroy the weakened portion 105 between such containers. The weakened portion 12 constitutes a fold line along which the two halves of a separated and filled container can be folded over each other so that the resulting "wallet" takes up a relatively small amount of space and can be readily introduced into a pocket, purse, or the like.

The reason for the provision of layers 108, 7*a* and 7*b* at that side of the intermediate or auxiliary weakened portion 12 which includes the compartment 10*a*' for film sections is that the width of the film sections normally constitutes a relatively small fraction of the width of photographic prints. In other words, the width of the compartment 10*a*' need not match that of the associated compartment 10*b*' so that the application of layers 7*a*, 7*b* and 108 at the left-hand side of the weakened portion 12 shown in the middle of FIG. 6 does not entail an excessive reduction of the size of the pocket 10*a*'. In fact, if the width of the prints greatly exceeds the width of the film sections, the width of the layers 7*a*, 7*b*, 108 and the distance between the layers 7*a* and 7*b* can be increased accordingly so as to ensure that a stack of superimposed or overlapping film sections will fit snugly into the pocket 10*a*' in order to avoid unnecessary shifting of such film sections subsequent to introduction into the respective container 10. It is preferred to place the auxiliary weakened portion 12 exactly or at least substantially midway between the respective weakened portions 105 to thus ensure that the two halves of the folded container 10 will have identical widths.

Each container 10 is further formed with an index or marker in the form of a slot 13 which is adjacent to the respective auxiliary weakened portion 12 and to that end of the layer 108 which faces the corresponding portion of the continuous adhesive layer 106. The slot 13 which is shown in FIG. 6 is adjacent to the left-hand side of the auxiliary weakened portion 12, i.e., it is provided in that half of the respective container 10 which also includes the pocket 10*a*' for film sections. The slot 13 extends through the cover 2 as well as through the corresponding portion of the web 1. Its purpose is to permit penetration of a scanning or monitoring device, such as a movable portion of a microswitch which thereby generates a signal denoting that the drive for the strip of containers 10 or for successive separated containers must be arrested in order to ensure accurate alignment of the pockets 10*a'* and 10*b'* with the corresponding components of the filling apparatus, namely, with those components which introduce stacks of film sections into the pocket 10*a'* and stacks of prints into the corresponding pocket 10*b'*. The slot 13 is located at one and the same distance from the auxiliary weakened portion 12 and in immediate proximity of the median adhesive layer 108 irrespective of the dimensions of the corresponding container 10. This ensures that such slot 13 can be used as an index or marker for proper stoppage of the transporting mechanism independently of the length of the corresponding container 10. This, in turn, ensures that a relatively narrow pocket 10*a'* or 10*b'* is just as accurately located with respect to the corresponding filling unit as a relatively wide pocket 10*a'* or 10*b'*. In a given series of coherent containers 10, each slot 13 is located at a fixed distance from the next-following weakened portion 105. This is advisable and necessary when such slot initiates the actuation of a second monitoring device, such as a second microswitch, which triggers separation of the corresponding container 10 from the next-following container preparatory to introduction of film sections and prints into the pockets 10*a'* and 10*b'* of the freshly separated container 10. Relatively small deviations of the distance between the slot 13 and the next-following weakened portion 105 from a predetermined distance are of no consequence because the mechanism which separates successive containers 10 from each other can be readily designed in such a way that it can properly separate neighboring containers from each other even if a signal for initiation of such separation is generated slightly ahead of or slightly after the optimum time. The second microswitch is preferably located ahead of the first-mentioned microswitch, as considered in the direction of transport of the series of containers 10. This is advisable for the reason which has been explained above, namely, successive containers 10 are preferably separated from the next-following containers prior to introduction of film sections and prints into the pockets 10*a'* and 10*b'*. It is clear that the slots 13 constitute but one acceptable form of indices or markers; such slots can be replaced by other types of markers which can be detected by optical, mechanical, pneumatic, electrical, electronic or other suitable monitoring means.

FIG. 8 illustrates a modified series or strip of coherent containers 10A which are especially suited for storage of relatively wide film sections and relatively large photographic prints. All such parts of the strip or series shown in FIG. 8 which are identical with or clearly analogous to the corresponding parts of the strip shown in FIGS. 6 and 7 are denoted by similar reference characters.

One of the main differences between the containers 10 of FIG. 6 and the containers 10A of FIG. 8 is that the containers 10A are devoid of adhesive layers 7*b* at that side of each weakened portion 12 which includes the compartment or pocket 10*a* for film sections. In addition, each container 10A comprises a flap 14 which is disposed between the right-hand weakened portion 105, as viewed in FIG. 8, and a second auxiliary or additional weakened portion 15 which is located immediately to the left of the respective elongated adhesive layer 209'. It will be noted that the relatively wide compartment or pocket 10*b* extends all the way between the weakened portions 12 and 15. The flap 14 comprises a further layer of adhesive here shown as a row of small adhesive patches 16 which is parallel to the layer 209' and is immediately adjacent to the nearest weakened portion 105. The strength of the auxiliary or additional weakened portion 15 can match or even exceed that of the weakened portion 12, i.e., it can greatly exceed the strength of the weakened portions 105 because the portion 15 merely serves as a fold line for predictable and convenient folding of the flap 14 over the outer side of the compartment 10*a* when the two halves of the container 10A are folded over each other subsequent to introduction of film sections and prints into the respective compartments 10*a* and 10*b*. If the continuous cover 2 of the strip shown in FIGS. 6 and 7 is replaced in FIG. 8 by an interrupted cover 2, the interruptions are preferably located in the region of the row of patches 16 so that such patches can be used to separably bond the folded-over flap 14 to the outer side of the respective pocket 10*a*.

The layer 7*a* of each container 10A has two narrow portions spaced from and surrounding parts of holes 11 which serve the same purpose as the holes 11 shown in FIG. 6. The layer 106 of the strip shown in FIG. 8 may but need not be continuous; as shown, this layer can be interrupted in that portion of each flap 14 which extends between the layer 209' and the neighboring weakened portion 105. On the other hand, the partitioning layer 108 extends or can extend all the way to the layer 106; in FIG. 8, the layer 108 is interrupted in part by the slot 13 whose position with reference to the adjacent weakened portion of fold line 12 is preferably the same as in each of the containers 10 shown in FIG. 6. This ensures that the partitioning layer 108 of each container 10A will be located between the transfer elements which introduce stacks of film sections and stacks of prints into the registering compartments 10*a* and 10*b* even if the transfer elements are the same elements which serve for introduction of narrower film sections and narrower prints into the compartments 10*a*, 10*b* of containers 10.

Referring now to FIG. 9, there is shown a portion of an apparatus which can be utilized to introduce stacks of film sections and stacks of photographic prints into the respective compartments of successive containers including those shown at 10/1, 10/2 and 10/3 in the lower portion of FIG. 9. The apparatus of FIG. 9 may be similar to or identical with that which is disclosed in commonly owned U.S. Pat. No. 4,154,046 granted May 15, 1979 to Klaus Weber for "Apparatus for processing developed photographic prints and films". Photographic prints 25 are obtained in response to severing of a continuous strip 17 of photographic paper which is fed in the direction of the arrow between elongated guide rails 19 and 20. The rail 19 is preferably fixed to its base or table 120 but the rail 20 is preferably adjustable in directions indicated by a double-headed arrow 20*a* so that the apparatus of FIG. 9 can treat relatively narrow or relatively wide paper strips 17. A photographic film 18 is transported in the direction of arrow 18*b*. The film 18 is connected to a customary backing or separating strip 18*a* and the assembly of film 18 and backing strip 18*a* is advanced between two elongated guide rails 21 and 22. The rail 22 is adjacent to the rail 19 and is preferably fixed to the base or table 120 but the other rail 21 is adjustable in directions indicated by a double-headed arrow 21*a* so that it can cooperate with the rail 22 in order to guide relatively wide or relatively narrow strips 18*a*. The reference character 23 denotes a severing mechanism which subdivides the film 18 into sections 26 of predetermined length, for example, into sections each of which comprises four or six film frames. The severing mechanism 23 is adjacent to a severing mechanism 24 for the paper strip 17. The mechanism 24 is designed to sever the paper strip 17 at regular intervals, namely, across successive frame lines 17*b* between neighboring prints 25. The details of the severing mechanism 23 and 24 are known and form no part of the present invention. Reference may be had to the aforementioned U.S. Pat. No. 4,154,046 whose disclosure is incorporated herein by reference.

The character 125 denotes a gathering or stacking station for successively severed discrete prints 25. A similar gathering or stacking station 126 is provided below the severing device 23, as viewed in FIG. 9, and includes a stacker serving to accumulate successive film sections 26 belonging to a particular customer into a stack which is ready for introduction into the aligned pocket 10*a* or 10*a'* depending upon whether the containers 10/1 to 10/3 are of the type shown in FIG. 6 or FIG. 8. Successively accumulated stacks of film sections 26 are transferred into the adjacent compartment or pocket 10*a* or 10*a'* by transfer elements 27. Similar transfer elements 27*a* are provided to advance successively accumulated stacks of prints 25 into the respective aligned compartment or pocket 10*b* or 10*b'*. The transfer elements 27 and 27*a* are set in motion to advance the freshly accumulated stacks of film sections 26 and photographic prints 25 in a direction away from the respective severing mechanisms 23 and 24 in response to signals denoting the termination of severing or subdivision of a particular customer film 18 and of the corresponding portion of the photographic paper strip 17.

The filling station 28 is located downstream of the paths of reciprocal movement of transfer elements 27 and 27*a*. This station accommodates two elongated parallel guide rails 29 and 30 for a continuous strip of coherent containers including the container 10/1, the container 10/2 and the container 10/3. The path of the strip including the containers 10/1 to 10/3 is indicated by the arrow A; such path is preferably horizontal, the same as the paths for the paper strip 17 and film 18. The table for the guide rails 29 and 30 supports a first microswitch 31 and a second microswitch 32 which latter is located ahead of the microswitch 31, as viewed in the direction of arrow A. In other words, the slot 13 of the foremost container 10/1 will advance past the microswitch 32 before it reaches the microswitch 31. The positions of the microswitches 31 and 32 are selected in such a way that they are adjacent to the path of movement of successive slots 13 in the region which is adjacent to the inner side of the rail 30. The first microswitch 31 is connected with the controls 33 for two toothed pulleys 34 having pins extending into the perforations 103 and 104 of the strip including the containers 10/1 to 10/3 so that such containers advance in the direction of arrow A when the drive for the pulleys 34 is on. The second microswitch 32 is connected with a clutch 35 and/or a braking device which influences a second toothed pulley 36. The pins of the pulley 36 enter the adjacent perforations 103 and 104 of the container thereabove. The pulley 36 is located ahead of the pulleys 34, as considered in the direction of advancement of successive containers between the guide rails 29 and 30. In other words, the perforations 103 and 104 of an oncoming container will be engaged by the pulley 36 and thereupon by the pulleys 34.

The operation of the apparatus which is shown in FIG. 9 is as follows:

The foremost container 10/1 is already separated from the container 10/2 which constitutes the leader of a strip of several coherent containers further including the container 10/3. The container 10/2 is introduced between the guide rails 29 and 30 by the pulleys 34 which pull it over the pulley 36. When the slot 13 of the container 10/2 reaches the microswitch 32, a movable portion of such microswitch penetrates into the slot 13 and the microswitch 32 thereby generates a signal which is transmitted to the clutch 35. Such signal arrests or disengages the drive for the pulley 36 while the pulleys 34 continue to rotate and to advance the container 10/2 in the direction of arrow A. The pulley 36 arrests the container 10/3 whereby the weakened portion 105 between the containers 10/2 and 10/3 is destroyed as a result of further rotation of pulleys 34 so that the container 10/2 is separated from the container 10/3. The pulleys 34 continue to transport the freshly separated container 10/2 to the filling station 28 whereby the slot 13 of such container reaches the microswitch 31 and a movable portion of the latter enters the slot 13 and thereby causes the switch 31 to transmit a signal to the controls 33 for the pulleys 34. The drive for the pulleys 34 comes to a halt at the exact moment when the corresponding compartments or pockets 10*a* and 10*b* or 10*a'* and 10*b'* are in accurate register with the stations 126 and 125. When the container 10/2 comes to a halt, a suction cup or a similar device lifts the flap 2*a* of the cover 2 away from the adjacent portion of the web 1 so as to provide the aforementioned funnel which allows for convenient introduction of stacks of film sections and photographic prints into the respective compartments. When the filling operation is completed, the drive for the pulleys 34 is set in motion again so that the pulleys 34 advance the container 10/2 beyond the filling station 28 and the container 10/3 is thereupon separated from the next-following container of the strip as soon as its slot 13 reaches the microswitch 32. The freshly separated container 10/3 is then advanced into the range of the microswitch 31 which arrests the drive for the pulleys 34 so that the container 10/3 comes to a halt in a position of exact alignment of its compartments with the respective stations 126 and 125.

If the apparatus of FIG. 9 treats containers 10 of the type shown in FIGS. 6 and 7, each container 10 which has advanced beyond the filing station 28 can be folded along the respective weakened portion or fold line 12 so as to form a relatively small wallet which can be introduced into an envelope for shipment or delivery to a customer or dealer.

If the apparatus of FIG. 9 treats containers 10A of the type shown in FIG. 8, a freshly filled container 10A which has been advanced beyond the filling station 28 is folded along the fold line 12 so that the pocket 10*a* overlaps the pocket 10*b* or vice-versa, and the flap 14 is thereupon folded along the line 15 so that it overlies the adjacent portion of the outer side of the respective pocket 10*a*. If the patches 16 are not exposed, the person in charge can use a piece of adhesive tape to secure the flap 14 to the outer side of the pocket 10*a*. Instead of a piece of adhesive tape, the attendant can also use a label which provides room for the application of information, such as the address or the number of the customer or dealer. In addition, such information may include the cost of the developing and printing operation and the cost of shipment or delivery to the customer or dealer.

Since the distance between the right-hand marginal portion of the film 18 and the left-hand marginal portion of the paper strip 17 is always the same irrespective of the width of the film 18 and/or paper strip 17, conversion of the apparatus which is shown in FIG. 9 for the stacking and introduction of narrower or wider film sections 26 and/or narrower or wider prints 25 does not necessitate any adjustment of component parts at the filling station 28. This will be readily appreciated since the width of the strip shown in FIGS. 6 and 7 is or can be the same as the width of the strip of FIG. 8 even though the compartments 10*a'*, 10*b'* are smaller (narrower) than the respective compartments 10*a*, 10*b* of the strip shown in FIG. 8. The reason for such absence of need for any adjustment of components at the filling station 28 is that the slots 13 are located in predetemined positions with reference to the median adhesive layers or partitions 108, i.e., the microswitches 31 and 32 do not and need not discriminate between wider or narrower containers (10 and 10A), and such absence of discrimination does not result in improper alignment of compartments 10*a*, 10*b* or 10*a'*, 10*b'* with the stations 126 and 125.

Another difference between the strips of containers which are shown in FIGS. 2*a*, 3*a*, 4*a* and 5*a* on the one hand, and the strips of containers 10 or 10A on the other hand, is that the perforations 103, 104 extend at right angles to the sides of the respective pockets or compartments 10*a'*, 10*b'* or 10*a*, 10*b* whereas the perforations 9 extend in parallelism with the sides of the corresponding compartments or pockets 6 and 7. Strips of the type shown in FIGS. 6 to 8 are preferred at this time because the apparatus of FIG. 9 has been found to be highly satisfactory for rapid introduction of stacks of film sections 26 and stacks of photographic prints 25. If such apparatus introduces film sections and prints into containers 10 or 10A, a strip of such containers can be guided past the stations 126, 125 in a manner as shown in the lower portion of FIG. 9. On the other hand, if the strip is of the type shown in FIGS. 2*a*, 3*a*, 4*a* or 5*a*, each freshly separated (foremost) container must be turned through 90 degrees in order to make sure that the open sides of its compartments 6 and 7 will face the stations 126 and 125. If the stations 126 and 125 are located in such a way that they face the open sides of compartments 6, 7 forming part of a strip which is of the type shown in FIGS. 2*a*, 3*a*, 4*a* or 5*a* and the strip advances between the guide rails 29, 30 of FIG. 9, the stations 126, 125 interfere with removal of freshly filled containers (such as the container of FIGS. 1 and 2) from the filling station and/or with transport of successive empty containers of the strip to the filling station.

Another advantage of strips of the type shown in FIGS. 6 to 8 is that the width of sheets 1 and 2 of which the containers 10 or 10A are made need not be changed in order to reduce or increase the widths of the compartments 10*a'*, 10*b'* or 10*a*, 10*b*. This means that the distance between the guide rails 29, 30 can remain fixed and that the distance between the pulleys 34 need not be changed when the operator wishes to shift from the filling of compartments 10*a'*, 10*b'* to the filling of compartments 10*a*, 10*b* or vice versa. An operator would be likely to forget to change the distance between the guide rails 29 and 30, i.e., the possibility of leaving the distance between such rails unchanged, even if the attendant wishes or decides to shift from the filling ofcontainers having relatively narrow or small compartments to the filling of containers with larger compartments, is an important advantage of the strips shown in FIGS. 6 to 8 and of the apparatus shown in FIG. 9.

Still another advantage of strips which include the containers 10 and 10A is that such containers are provided with the aforediscussed markers or indices 13 for actuation of the microswitches 31 and 32. While it is possible and, in some instances, advantageous to utilize selected perforations 9 in lieu of discrete markers or indices (such as the slots 13), discrete markers are preferred at this time because they allow for more predictable stoppage of freshly separated foremost containers at the filling station and for reliable separation of such containers from the next-following containers ahead of the filling station 28. As mentioned above, the perforations 9 of each row of such perforations are equidistant from each other so that it is not always possible to use these perforations for stoppage of successive containers in predetermined positions at the filling station because, while the spacing between neighboring perforations 9 of a row might be quite satisfactory to ensure predictable stoppage of containers with relatively large compartments, the same spacing will not ensure equally predictable stoppage of containers having smaller compartments.

The flaps 14 render it possible to prevent unintentional opening of a container 10A which has been folded along the respective line 12 so that the compartments 10*a* and 10*b* overlie each other and the flap 14 overlies a portion of the outer side of the compartment 10*a*.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. An elongated strip comprising a plurality of containers, each container having at least two open and distinct compartments, one for developed film and the other for prints of a customer order, said strip being constituted by two superimposed elongated sheets each having two marginal portions and generally uniform width, each of said compartments having four marginal edges, three of said marginal edges being formed by securing the two sheets together, the fourth marginal edge of each compartment being open and being disposed at one side of said strip so that the film and the prints can be inserted in appropriate compartments from said one side, two of said three marginal edges being adjacent said open fourth marginal edge and terminating short of said fourth marginal edge and said strip further having a tear line between each of said containers and the next adjacent container, said tear lines extending across the width of the two sheets, as considered transversely of said marginal portions, and said strip also having a fold line extending across each of said containers, said containers being foldable over each other along the tear lines for handling and then separable along such tear lines into individual containers, each such individual container being in turn foldable along the respective fold line to provide a plural-compartment wallet, one of said sheets having along and in at least one of its marginal portions a row of equidistant perforations and the width of the other sheet being less than that of said one sheet to leave exposed at least one marginal portion of the one sheet at said open fourth marginal edges of said compartments.

2. A strip as defined in claim 1, wherein one sheet of each container consists of paper, foil or cardboard and the other sheet of each container consists of paper, parchment or synthetic plastic material.

3. A strip as defined in claim 1, wherein one sheet of each container transmits light.

4. An elongated strip comprising a plurality of containers, each container having at least two open and distinct compartments, one for developed film and the other for prints of a customer order, said strip being constituted by two superimposed elongated sheets each having two marginal portions and a generally uniform width, each of said compartments having four marginal edges, three of said marginal edges being formed by securing the two sheets together, the fourth marginal edge of each compartment being open and being disposed at one side of said strip so that the film and the prints can be inserted in appropriate compartments from said one side, two of said three marginal edges being adjacent said open fourth marginal edge and terminating short of said fourth marginal edge and said strip further having a tear line between each of said containers and the next adjacent container, said tear lines extending across the width of the two sheets, as considered transversely of said marginal portions, and said strip also having a fold line extending across each of said containers, said containers being foldable over each other along the tear lines for handling and then separable along such tear lines into individual containers, each such individual container being in turn foldable along the respective fold line to provide a plural-compartment wallet.

5. An elongated strip comprising a plurality of containers, each container having at least two open and distinct compartments, one for developed film and the other for prints of a customer order, said strip being constituted by two superimposed elongated sheets each having two marginal portions and a generally uniform width, each of said compartments having four marginal edges, three of said marginal edges being formed by securing the two sheets together, the fourth marginal edge of each compartment being open and being disposed at one side of said strip so that the film and the prints can be inserted in appropriate compartments from said one side, two of said three marginal edges being adjacent said open fourth marginal edge and terminating short of said fourth marginal edge and said strip further having a tear line between each of said containers and the next adjacent container, said tear lines extending across the width of the two sheets, as considered transversely of said marginal portions, and said containers being foldable over each other along the tear lines for handling and then separable along such tear lines into individual containers, one of said sheets having along and in at least one of its marginal portions a row of equidistant perforations and the width of the other sheet being less than that of said one sheet to leave exposed at least one marginal portion of the one sheet at said open fourth marginal edges of said compartments.

6. An elongated strip comprising a plurality of containers, each container having at least two open and distinct compartments, one for developed film and the other for prints of a customer order, said strip being constituted by two superimposed elongated sheets each having two marginal portions, each of said compartments having four marginal edges, three of said marginal edges being formed by securing the two sheets together, the fourth marginal edge of each compartment being open and being disposed at one side of said strip so that the film and the prints can be inserted in appropriate compartments from said one side, two of said three marginal edges being adjacent said open fourth marginal edge and terminating short of said fourth marginal edge and said strip further having a tear line between each of said containers and the next adjacent container, said tear lines extending across the width of the two sheets, as considered transversely of said marginal portions, and said containers being foldable over each other along the tear lines for handling and then separable along such tear lines into individual containers, one of said sheets having along and in at least one of its marginal portions a row of equidistant perforations and the width of one of said sheets being less than that of the other sheet.

7. An elongated strip comprising a plurality of containers, each container having at least two open and distinct compartments, one for developed film and the other for prints of a customer order, said strip being constituted by two superimposed elongated sheets each having two marginal portions and a generally uniform width, each of said compartments having four marginal edges and three of said marginal edges being formed by securing the two sheets together, the fourth marginal edge of each compartment being open and being disposed at one side of said strip so that the film and the prints can be inserted in appropriate compartments from said one side, two of said three marginal edges being adjacent said open fourth marginal edge and terminating short of said fourth marginal edge and said strip further having a tear line between each of said containers and the next adjacent container, said tear lines extending across the width of the two sheets, as considered transversely of said marginal portions, and said containers being separable into individual containers along said tear lines, one of said sheets having along and in at least one of its marginal portions a row of equidistant perforations and the width of the other sheet being less than that of said one sheet to leave exposed at least one marginal portion of the one sheet at said open fourth marginal edges of said compartments.

8. An elongated strip of plural coherent containers, each container having two open and distinct compartments, one for developed film and the other for prints of a customer order, said strip being constituted by two superimposed elongated flexible sheets each having two marginal portions and a generally uniform width, each of said compartments having four marginal edges, three of said marginal edges being formed by securing the two sheets together, one of the three marginal edges of one compartment of each container being integral with one of the three marginal edges of the other compartment of the respective container and constituting therewith a partition extending transversely of said strip, the fourth marginal edge of each compartment being open and being disposed at one side of said strip so that the film and the prints can be inserted in appropriate compartments from said one side, two of said three marginal edges of each compartment being adjacent the respective open fourth marginal edge and terminating short of such fourth marginal edge and said strip further having a tear line between each of said containers and the next adjacent container, said tear lines extending across the width of the two sheets of said strip, as considered transversely of said marginal portions, and said containers being separable into individual containers along such tear lines, each such individual container being in turn foldable due to flexibility of said sheets to constitute a plural-compartment wallet, one said sheets having along and in at least one of its marginal portions a row of equidistant perforations and the width of one of said sheets being less than the width of the other sheet.

9. The strip of claim 8, wherein the partition of each of said containers has a fold line.

10. The strip of claim 8, wherein each of said containers has a fold line which is adjacent to one side of the respective partition.

11. The strip of claim 8, wherein each of said containers has two fold lines which flank the respective partition.

12. The strip of claim 8, wherein each of said containers has a fold line extending at least substantially transversely of the strip and being parallel to the respective partition.

13. A strip as defined in claim 8, wherein each of said containers has a row of perforations in said partition thereof.

14. A strip as defined in claim 8, further comprising a perforated tape applied to each of said partitions.

15. A strip as defined in claim 14, wherein said partitions are doubled over themselves and each tape adheres to an outer side of the respective partition.

16. A strip as defined in c1aim 1, wherein each of said compartments further comprises a closed end located opposite the respective open end, each of said containers extending transversely of said strip, as considered in a direction from the open toward the closed ends of the compartments.

17. A strip as defined in claim 8, wherein each of said containers has a marker located at a predetermined distance from the respective partition.

* * * * *